US007367748B2

(12) United States Patent
Groebner et al.

(10) Patent No.: US 7,367,748 B2
(45) Date of Patent: May 6, 2008

(54) METHOD OF INSTALLING TRACER WIRE WITH PIPELINE UTILIZING HORIZONTAL DIRECTIONAL DRILLING

(75) Inventors: Joseph Matthew Groebner, Maple Grove, MN (US); Daniel Edward Pajak, Skaneateles, NY (US)

(73) Assignee: Copperhead Industries LLC., Monticello, MN (US)

( * ) Notice: Subject to any disclaimer, the term of this patent is extended or adjusted under 35 U.S.C. 154(b) by 263 days.

(21) Appl. No.: 11/269,447

(22) Filed: Nov. 8, 2005

(65) Prior Publication Data

US 2007/0104541 A1 May 10, 2007

(51) Int. Cl.
*E03B 7/07* (2006.01)

(52) U.S. Cl. ..... 405/157; 405/184; 166/250.01

(58) Field of Classification Search ..... 405/184, 405/157; 166/250.01
See application file for complete search history.

(56) References Cited

U.S. PATENT DOCUMENTS

2004/0184885 A1* 9/2004 McGillis ..... 405/184
2004/0222009 A1* 11/2004 Blew et al. ..... 174/110 F
2005/0191133 A1* 9/2005 Purcell ..... 405/157

* cited by examiner

*Primary Examiner*—Sunil Singh
*Assistant Examiner*—Sean D Andrish
(74) *Attorney, Agent, or Firm*—Westman, Champling & Kelly, P.A.

(57) ABSTRACT

A method of installing a non metallic pipeline segment along with a tracer wire segment using a horizontal directional drilling process includes positioning a horizontal directional drilling machine in a selected position on one side of the obstacle. A drill bit is attached to an end of a flexible steel pipe. The flexible steel pipe engages and is driven by the horizontal directional drilling machine that forces the drill bit and the flexible pipe from the first side of the obstacle to a second side of the obstacle thereby drilling a bore underneath the obstacle. The drill bit is removed and a reamer is attached to the end of the flexible pipe. An end of a pipeline segment along with an end of a tracer wire segment having a high carbon steel core and a copper cladding with a high density polyethylene jacket is attached to the reamer. The drive of the horizontal directional drilling machine is reversed such that the reamer pulls the pipeline and the tracer wire back through the bore beneath the obstacle such that an end of the segment of the pipeline and an end of the segment of the tracer wire extends beyond the first surface of the obstacle.

17 Claims, 1 Drawing Sheet

METHOD OF INSTALLING TRACER WIRE WITH PIPELINE UTILIZING HORIZONTAL DIRECTIONAL DRILLING

BACKGROUND OF THE INVENTION

The present invention relates to horizontal directional drilling. More particularly, the present invention relates to a method of installing a tracer wire segment above a pipeline segment utilizing a horizontal directional drilling process.

Utility companies commonly install non-metallic pipelines to reduce cost. A common non-metallic material of construction for a utility pipeline is polyethylene. Polyethylene pipelines are used by a variety of utilities including, but not limited to, natural gas, water and telecommunications.

Because the pipeline is non-metallic, once the pipeline is buried, it is difficult to precisely determine the pipeline's location. To aid in locating the pipeline, a tracer wire may be installed along with the pipeline such that the location of the pipeline can be detected with a metal detector or a device that detects a signal transmitted along the tracer wire. Typically the tracer wire is positioned between 6 inches and 12 inches above the pipeline to minimize the risk of lightening traveling down the tracer wire and melting or damaging the non-metallic pipeline.

In many instances, the utilities must install the pipeline under an obstacle such as a driveway, a road, a railroad track or a body of water such as a river, a lake or a swamp. Many times, the utility will employ a horizontal directional drilling process that drills a bore beneath the obstruction without causing damage to the above ground landscape where the pipeline segment is installed within the bore.

However, the cost associated with the horizontal directional drilling process are substantially higher than the cost associated with the traditional method of digging a trench and laying the pipe into the trench. While digging a trench may be less expensive than horizontal directional drilling, digging a trench harms the aesthetic appearance of the landscape. In some instances, a trench installation may not be feasible such as when a segment of the pipeline must be installed below a body of water.

The horizontal directional drilling process begins by attaching a drill bit to a length of flexible pipe. The flexible pipe is attached to a horizontal directional-drilling machine which is positioned on one side of the obstruction. The horizontal drilling machine urges the drill bit into the ground to drill a bore beneath the obstruction to another side of the obstruction. At times, the bore can be over a mile in length and having a diameter that is capable of accommodating a pipeline segment having a 12 inch diameter.

When the drill bit bores through to the other side of the obstruction, the drill bit is removed and a reamer is attached to the flexible drilling pipe. An end of a pipeline segment and an end of the tracer wire segment are attached to the reamer. The directional drilling machine pulls the pipeline segment and the tracer wire segment through the bore in the opposite direction of the drill bit. This step in the horizontal directional drilling process is referred to as the "pull back."

As the reamer pulls the pipeline segment and the tracer wire back through the bore, the tracer wire incurs a significant amounts of stresses and strains which has a tendency of causing the tracer wire to break. When the tracer wire breaks, a new bore must be drilled beneath the obstacle and the pull back process must be repeated. Having to repeat the boring and pull back process causes an increase in the time required to complete the project which substantially increases the cost of the project.

A common tracer of wire is a solid copper wire because solid copper is easily detected with a metal detector and has a low resistance which allows a signal to be transmitted down the wire to detect a break. However, a copper wire may not have enough tensile strength to withstand the stresses and strains incurred during the pull back process resulting in the tracer wire segment breaking.

To compensate for the lack of strength of a copper wire, a solid stainless steel wire may be used as the tracer wire. The stainless steel wire has the advantage of being able to withstand a significant amount more stress and strain than a solid copper wire. However, a stainless steel wire is substantially more expensive than a copper wire and has a higher resistance which impedes the transmission of a signal as compared to a copper wire. Therefore, horizontal directional drilling companies are in need of an inexpensive but strong wire that is easily detected but able to transmit a signal along a length of the wire without much resistance.

SUMMARY OF THE INVENTION

The present invention includes a method of installing a tracer wire segment along with a pipeline segment beneath an obstacle utilizing a horizontal directional drilling procedure. The method includes drilling a bore from a proximal side of the obstacle to a distal side of the obstacle by utilizing a drill bit attached to a flexible pipe which is powered by a directional drilling machine. Once the drill bit exits the distal side of the obstacle, the drill bit is removed and a reamer is attached to the flexible pipe. The pipeline segment and the tracer wire segment having a carbon steel core clad with copper and encased with a high density polyethylene coating are attached to the reamer. The reamer is pulled through the through bore in the opposite direction of the direction of the drill bit to install the pipeline segment and the tracer wire wherein the tracer wire segment is able to withstand the stresses and strains of the installation process.

DETAILED DESCRIPTION OF ILLUSTRATIVE EMBODIMENTS

Figure 1:
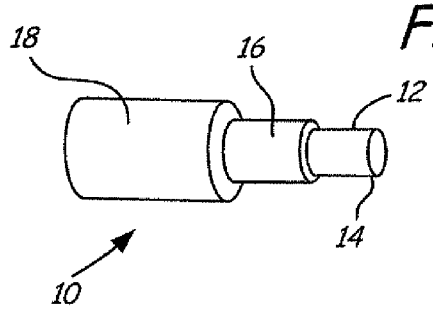
FIG. 1 is a cutaway view of the tracer wire of the present invention.

The present invention includes a method for installing a tracer wire along with a non metallic pipeline beneath an obstacle using a horizontal directional drilling process. Referring to FIG. 1, the tracer wire 10 employed in the method of the present invention includes a copper clad steel wire. The copper clad steel wire 10 includes a steel core 12 preferably of a high carbon steel, having a copper cladding 16 bonded to an exterior surface 14. A low carbon steel may also be used. The copper cladding 16 preferably bonds to the exterior surface 14 of the high carbon steel core 12 with a pressurized heating process that metallurgically bonds the copper cladding 16 to the exterior surface 14 of the high carbon steel core 12. However, any copper clad steel wire is within the scope of the present invention.

A preferred copper clad steel wire 10 is manufactured by Copperweld Corporation of Fayetteville, Tenn. The copper clad steel wire is preferably a 10 gauge wire, a 12 gauge wire, or a 14 gauge wire. However, other wires having other gauges are within the scope of the present invention.

The copper clad wire 10 is preferably coated with a high density polyethylene jacket 18 through an extrusion process. The high density polyethylene jacket 18 is preferably between about 25 mil and about 50 mil in thickness and more preferably between about 30 mil and about 45 mil in thickness. A preferred high density polyethylene jacket 18 is extruded onto the copper clad wire 10 by Performance Wire & Cable, Co. of Camden, N.Y.

While a high density polyethylene jacket is preferred, other polymeric materials can be utilized to form the jacket for the tracer wire. The polymeric material can be colored any color, including a distinguishing color such that the tracer wire is more easily detected during the excavation process or to aid in determining the type of pipeline the tracer wire is proximate to.

It has been discovered that the carbon steel copper clad wire 10 having the high density polyethylene jacket 18 is well suited for a tracer wire that is installed during a horizontal directional drilling procedure. The copper clad steel wire 10 having the high density polyethylene coating 18 is able to withstand the tension, stress and strain caused by the pull back step of the horizontal directional drilling process.

When compared to a solid copper wire, the copper clad steel wire 10 having polyethylene jacket 18 of the present invention has an increased breaking strength and increased tensile strength due to its steel core. The copper clad steel wire 10 has about a six times greater breaking strength than a solid copper wire. The increased breaking strength reduces the likelihood of the costly re-boring process in the event that the copper clad steel wire 10 breaks during the reaming process.

While having a high breaking strength, the wire 10 maintains its flexibility and therefore is able to flex as the wire 10 is being pulled through the bore. Also, the high carbon steel inner core 12 allows the wire 10 to stretch about 5 percent of its length to accommodate ground movement when installed which reduces the likelihood of the tracer wire 10 breaking after being installed.

While being stronger than a solid copper wire, the copper clad steel wire 10 having a copper cladding 14 is less expensive than a solid copper wire and thereby reduces material costs. Also, a wire having a copper cladding reduces the likelihood of the copper clad steel wire 10 being stolen from the installation site due to its lack of after market or scrap value. The copper clad steel wire 10 also weighs about 11% less than a solid copper wire. The reduction in weight reduces the cost of transporting the copper clad steel wire 10 to a job site when compared to shipping a solid copper wire.

A solid stainless steel wire has flexibility and increased breaking strength to be utilized as a tracer wire. However, a solid stainless steel wire is very expensive relative to the copper clad steel wire 10 of the present invention.

The copper clad steel wire 10 of the present invention also eliminates corrosion at the connection of two tracer wire segments because the material connecting the two tracer wire segments has the same metallurgy. The outer layer 16 of the copper clad steel wire 10 is essentially copper and when two wire segments are connected, the connection is that of a copper wire to copper wire which eliminates potential corrosion due to the dissimilar materials being connected to each other.

Figure 2:
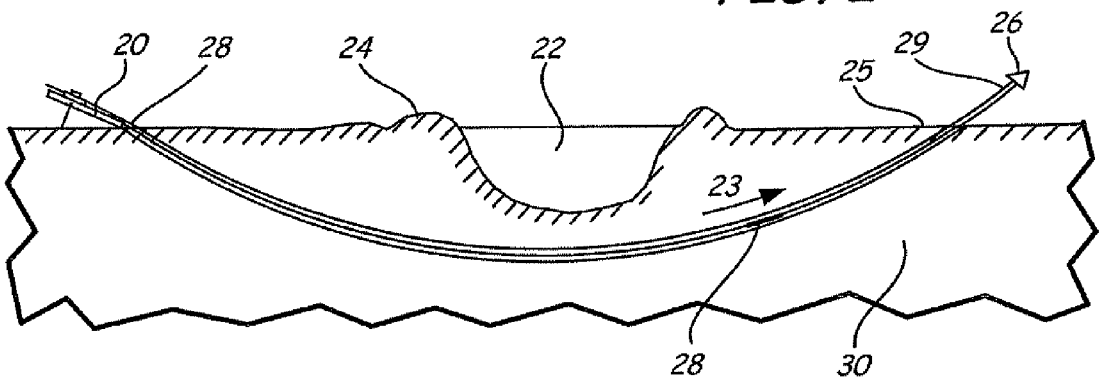
FIG. 2 is a cutaway view of a bore being created beneath an obstacle using a directional drilling process.

Referring to FIG. 2, the tracer wire 10 is installed by first positioning a horizontal directional drilling machine 20 near a proximal side 24 of a body of water 22. A drill bit 26 is attached to an end 29 of a flexible pipe 28 which is driven by the horizontal directional drilling machine 12. The horizontal directional 25 drilling machine 12 powers and rotates the drill bit 26 in a direction of arrow 25 to drill a bore 30 from the proximal side 24 of the obstacle 22 in a direction of arrow 25 to a distal side 25 of the obstacle 22. While an obstacle in the form of a body of water is illustrated, the form of the obstacle is not important and can be one of a number of obstacles including, but not limited to, a road, a runway, a railroad, and/or a body of water.

Figure 3:
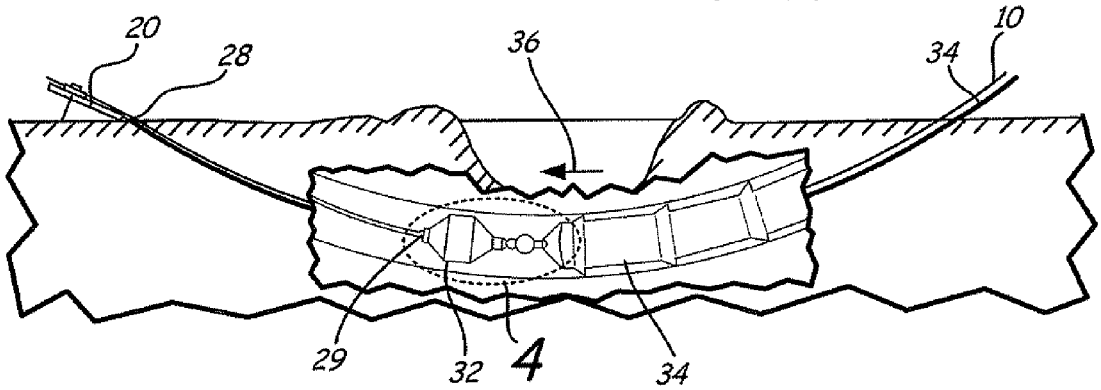
FIG. 3 is a cutaway view of a reamer being pulled through the through bore created by the directional drilling process having a pipeline segment and a segment of tracer wire attached thereto.
Figure 4:
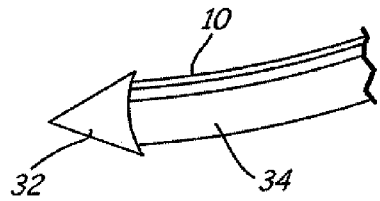
FIG. 4 is a diagrammatical view of the area in dotted line 4 in FIG. 3.

Referring to FIG. 3, once the drill bit 26 exits the distal side 25 of the obstacle 22, the drill bit 26 is removed from the end of the flexible pipe 28 and a reamer 32 is attached to the end of the flexible pipe 28. An end of a non-metallic pipeline segment 34, preferably constructed of polyethylene, and an end of the tracer wire segment 10 of the present invention are attached to the reamer 32. The drive on the horizontal directional drilling machine 20 is reversed such that the horizontal direction drilling machine begins to pull the reamer 32 along with the non-metallic pipeline segment 34 and the tracer wire segment 10 of the present invention back through the bore 30 in a direction opposite to the drilling direction and indicated by arrow 36.

During the pull back process, the non-metallic pipeline segment 34 and the tracer wire segment 10 are subjected to a great amount of tension, stress and strain. It has been found that the tracer wire 10 of the present invention withstands the tension, stress and strain created during the pull back process and is not likely to snap or break.

Once a reamer 32 along with the end of the polyethylene pipeline segment 34 and the end of the tracer wire segment 10 of the present invention are pulled through from the distal side 25 to the proximal side 24 of the obstacle 22, the reamer 32 is detached from the pipeline segment 34 and the tracer wire segment 10 such that the end of the pipeline segment 34 can be attached to another segment of the pipeline and the tracer wire segment 10 can be attached to another segment of the tracer wire.

One skilled in the art will recognize that the tracer wire 10 of the present invention minimizes the need to drill a second bore by eliminating the likelihood of the tracer wire 10 snapping during the pull back process. Therefore, the tracer wire 10 of the present invention saves a significant amount of time and money in the horizontal directional drilling process.

Although the present invention has been described with reference to preferred embodiments, workers skilled in the art will recognize that changes may be made in form and detail without departing from the spirit and scope of the invention.

What is claimed is:

1. A method of installing a tracer wire segment and a pipeline segment beneath an obstacle using a horizontal directional drilling process, the method comprising:

positioning a horizontal directional drilling device on a first side of the obstacle;

attaching a drill bit to an end of a flexible pipe that is driven by the horizontal directional drilling machine;

driving the drill bit and the flexible pipe from the first side to a second side of the obstacle to form a bore wherein the drill bit exits the second side of the obstacle;

removing the drill bit from the flexible pipe;

attaching a reamer to the end of the flexible pipe;

attaching an end of the pipeline segment to the reamer;

attaching an end of tracer wire segment having a high density carbon steel core with a copper cladding and a high density polyethylene jacket to the reamer;

reversing a direction of the drive of the horizontal directional drilling machine; and pulling the pipeline segment and tracer wire back through the bore from the second side to the first side of the obstacle wherein the end of the pipeline segment attaches to another segment of the pipeline proximate the first side and an end of the tracer wire segment attaches to another segment of the tracer wire proximate the first side.

2. The method of claim 1 and wherein the tracer wire positions about 6 inches above the pipeline beneath the obstacle.

3. The method of claim 2 and wherein the tracer wire positions about 12 inches above the pipeline beneath the obstacle.

4. The method of claim 1 and wherein the tracer wire comprises a 10 gauge wire, a 12 gauge wire or a 14 gauge wire.

5. The method of claim 1 and wherein the pipeline comprises a non metallic pipeline.

6. The method of claim 1 and wherein the pipeline comprises a polyethylene pipeline.

7. The method of claim 1 and wherein the pipeline comprises a utility pipeline.

8. The method of claim 1 and wherein the pipeline comprises a natural gas pipeline.

9. The method of claim 1 and wherein the pipeline comprises a water pipeline.

10. The method of claim 1 and wherein the high density polyethylene comprises a distinguishing color.

11. A method for installing a tracer wire segment and a non metallic pipeline segment beneath an obstacle by employing a horizontal directional drilling procedure, the method comprising:

providing a directional drilling machine located at a first side of an obstacle and having a flexible pipe engaged thereto with a drill bit attached to an end of the flexible pipe;

urging the drill bit and the flexible pipe into the obstacle utilizing a drive mechanism of the horizontal directional drilling machine to drill a bore from a first side of an obstacle to a second side of the obstacle;

detaching the drill bit from the end of the flexible pipe at the second side of the obstacle;

attaching a reamer to the end of the flexible pipe;

attaching an end of the pipeline segment and an end of the tracer wire segment to the reamer wherein the tracer wire segment comprises a copper clad steel wire having a polymeric jacket; and reversing a direction on the drive mechanism of the horizontal directional drilling machine to pull the pipeline segment and tracer wire segment from the second side of the obstacle to the first side of the obstacle.

12. The method of claim 11 and wherein the polymeric material comprises a high density polyethylene.

13. The method of claim 11 and wherein the jacket comprises between about a 30 mil thickness and a 45 mil thickness.

14. The method of claim 11 and wherein the steel copper clad wire comprises a high carbon steel core.

15. The method of claim 11 and wherein the copper clad steel wire comprises a 10 gauge wire, a 12 gauge wire or a 14 gauge wire.

16. The method of claim 11 and a breaking strength of the copper clad steel wire is at least four times greater than a breaking strength of a solid copper wire having the same gauge.

17. The method of claim 13 and wherein the copper clad steel wire stretches to about 5 percent a length of the wire.

* * * * *